United States Patent [19]

Becker et al.

[11] Patent Number: 4,852,332

[45] Date of Patent: Aug. 1, 1989

[54] PROCESS FOR TREATING FILAMENTARY OR THREAD TEXTILE MATERIAL

[76] Inventors: Hubert Becker; Josef Becker; Matthias Becker, all of Niederforstbacher Str. 80-84, 5100 Aachen, Fed. Rep. of Germany

[21] Appl. No.: 189,634

[22] Filed: May 3, 1988

[30] Foreign Application Priority Data

May 23, 1987 [DE] Fed. Rep. of Germany ..... 3717495

[51] Int. Cl.[4] ..... B65B 35/50; B65B 53/02; B65B 63/02; B65B 63/04

[52] U.S. Cl. ..... 53/436; 53/442

[58] Field of Search ..... 53/430, 436, 442, 447, 53/526, 557; 206/391, 394, 397

[56] References Cited

U.S. PATENT DOCUMENTS

| | | | |
|---|---|---|---|
| 3,362,128 | 1/1968 | James | 53/447 X |
| 3,600,875 | 8/1971 | Buob | 53/442 |
| 3,999,357 | 12/1976 | Marantz | 53/442 |
| 4,434,603 | 3/1984 | Beumer | 53/557 |
| 4,562,689 | 1/1986 | Hannen | 53/442 X |

FOREIGN PATENT DOCUMENTS 2713239 5/1986 Fed. Rep. of Germany .

*Primary Examiner*—Robert L. Spruill
*Assistant Examiner*—Ann Tran
*Attorney, Agent, or Firm*—W. G. Fasse; D. H. Kane, Jr.

[57] ABSTRACT

Filamentary or thread textile material is wound onto lap creels (2), which are capable of being pushed, in a telescoping manner, one into the other to form stacks (3). Each stack (3) is covered with a film tube or hose (6) which is shrunk onto the stack for holding together the individually wound lap creels (2). Immediately prior to a treatment, several stacks (3) are formed into a column, which is compacted by an axially effective compression. The slackened tension of the film tube (6) is then re-established by renewed shrinkage thereof prior to or at the start of the treatment of the textile material. Film material capable of repeated shrinking, especially heat shrinking is used for this purpose.

6 Claims, 1 Drawing Sheet

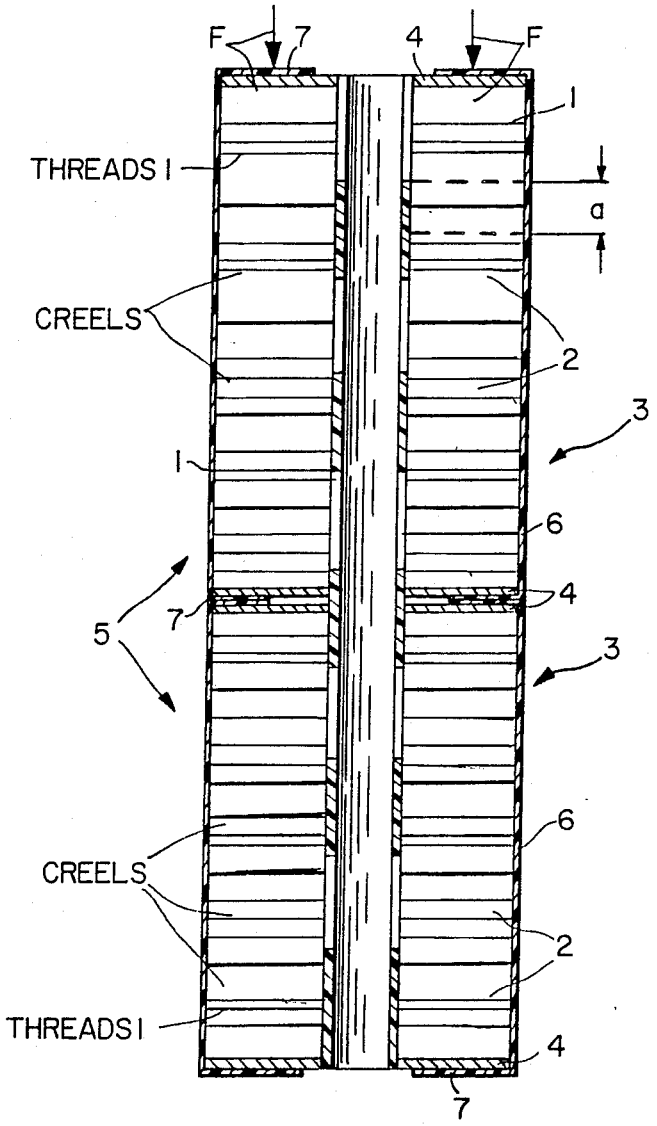
F
7
4
F
1
THREADS I
a
CREELS
2
3
1
6
4
7
5
3
6
CREELS
2
THREADS I
4
7

PROCESS FOR TREATING FILAMENTARY OR THREAD TEXTILE MATERIAL

FIELD OF THE INVENTION

This invention relates to a process for treating filamentary or thread textile material which is wound in coils on lap creels capable of being pushed telescopically, at least partially, one into the other. In this manner stacks of wound package carriers are formed. Film provided with uniform surface perforations is then drawn over and shrink-fitted onto each such stack.

DESCRIPTION OF THE PRIOR ART

Such a process is known from German Patent Publication (DE-PS) No. 2,713,239. The known process is supposed to make it possible to compress the filamentary or thread textile material on the package carriers to almost any desired package volume and corresponding dimensions without uncontrollable deformations so that the textile material can thereafter be subjected to a homogeneous wet treatment followed by drying and conditioning. The enveloping of the stack in perforated film causes an additional compression of the textile material in the radial direction of the stack and thus prevents breaking apart. The film envelope also prevents an uncontrolled deformation of the individual coils. Irrespective of the availability of a material carrier which receives a number of wound lap creels, with the aid of the known process, stacks of bobbins or wound lap creels can be formed and stocked. Such bobbins can be compressed on equipment separate from the dyeing apparatus, and can be sheathed or enveloped with the film which maintains the compression or compaction in the axial direction and brings about a supplementary compression in the radial direction.

As a result of being able to hold stacks of bobbins in stock in this way for the further treatment, it is possible to charge a material carrier with complete stacks in a fraction of the time previously needed for charging the material carrier with individual bobbins, and thus more economically.

A disadvantage of the known process is that stacks of wound lap creels or bobbins of a height corresponding to the capacity of a dyeing container are difficult to handle so such stacks are normally only produced and provided with the shrink foil after transportation of the wound lap creels into the vicinity of the dyeing apparatus. However, to protect the filamentary textile material or threads it would be desirable to envelop or sheath the wound lap creels immediately after their origin or completion in the spinning shop by a film which would then remain on the wound lap creels, not only during their transportation, but also during their entire treatment. The film envelope would be removed only immediately before the filamentary textile material is unwound from the lap creels for further processing.

OBJECTS OF THE INVENTION

In view of the foregoing it is the aim of the invention to achieve the following objects singly or in combination:

to retain all the advantages of the above prior art process, while simultaneously improving said process in such a way that lap creel units already protected by foil can be easily handled;

to envelop stacks of wound lap creels directly upon their completion; and to subject the film to separate shrinking steps.

SUMMARY OF THE INVENTION

According to the invention a stack of wound lap creels is formed substantially immediately upon completion of the winding operation, whereby the stacks can be axially compressed at least partially. However, before such axial compressing the stacks are enveloped by a repeatedly shrinkable perforated film material which is drawn over and shrink-fitted onto the stacks immediately after the winding of the lap creels to enclose each stack in an envelope of said perforated film material. Thereafter, but prior to treatment, several stacks are placed together to form a column and the column is compressed under axially applied pressure which slackens each envelope, whereupon any slack in the tension of the film envelopes is re-established by a renewed shrinkage until the foil tautly envelopes each stack in the compressed column.

Thus, in accordance with the method of the invention, immediately after the winding of the lap creels, stacks are formed which extend in height only over a fraction of the height available in the dyeing container. Then, film, preferably a repeatedly shrinkable film hose, is drawn onto each of these stacks and is shrink-fitted thereon. In this way textile material units are formed which are manageable and transportable. These units are put together to form larger columns only immediately prior to a wet treatment, each column then being compressed by the application of axially effective pressure. Due to the compression the tension of the previously shrink-fitted film slackens and folds arise over the circumference of the film wrapping which may hinder a uniform flow of the treatment medium through the film, particularly when the treatment medium is intended to penetrate the packages radially from the inside outwardly and/or from the outside inwardly through the perforated film material. Since the initial treatment medium is usually heated dyeing liquor, tautening of the respective film can conveniently be brought about by renewed shrinkage thereof at the start of the treatment due to the textile material being acted upon by such a heated treatment medium.

Alternatively, however, each column, formed of a number of stacks, can be exposed to a film shrinking temperature, after coaxial compression, but prior to the treatment of the textile material. Such separate heat treatment may be performed, for example by passing the compressed columns through special heat-treatment equipment, in order to bring about the required renewed or second shrinkage of the film envelope.

As a result of the present proposal the stacks formed, in each case of a number of wound lap creels, result in textile units which are manageable and transportable and which are protected against damage by the foil subsequent to its first shrinking.

Advantageously, each stack is formed of three to six wound lap creels and each column is formed of two or three stacks.

BRIEF DESCRIPTION OF THE DRAWING

In order that the invention may be clearly understood, it will now be explained with reference to the accompanying drawing, of which the single FIGURE shows a schematic view of a column with a total of ten lap creels.

DETAILED DESCRIPTION OF PREFERRED EXAMPLE EMBODIMENTS AND OF THE BEST MODE OF THE INVENTION

As illustrated, two stacks 3 are each formed of five lap creels 2 wound with filamentary textile material or thread 1, for example in a cross-over pattern as shown. The end faces of each of these stacks 3 are covered by respective annular discs 4 and the stacks 3 are arranged coaxially one above the other, thereby forming a column 5.

The thus assembled stacks 3 are compressed in the coaxial direction with the aid of appropriate equipment, not shown, for applying axial, longitudinally effective forces F so that the lap creels 2 telescope into one another to an extent "a", while the textile thread 1 is correspondingly compacted.

However, prior to assembly of the stacks 3 into a column 5, and in the still uncompacted state, each stack 3 has been covered with a film tube or hose 6 which is perforated uniformly over its surface and this hose 6 has been shrunk onto each stack 3 so that its ends 7 have been drawn tightly around the respective annular dics 4. The shrunk-on film tube 6 thus exerts a pressure which is distributed uniformly over the stack periphery, or rather on the outer surface of the wound thread. This pressure is directed radially inwardly and with the film tube ends 7 drawn tightly around the annular discs 4, it additionally creates, by the shrinking force of the film, a tensile force which is axially effective relative to the respective stack 3.

After the easily manageable stacks 3 have been arranged coaxially one above the other into a column 5, only then is the axial compaction of the column 5 effected. This axial compression leads at the same time to a compaction of the individual thread windings by the extent "a" mentioned above. The shrink-fitted film tubes 6 become loose in the axial direction due to such axial compaction. However, the above mentioned tensioning force can be regained according to the invention by a renewed shrinkage of the film tubes 6, and for this purpose the column 5 is either conducted through an appropriate heat-treatment device or is simply acted upon by the customary heated treatment medium applied to the textile thread, so that at the start of the treatment the film tubes 6 again tautly surround the stacks 3 and thus the column 5 as a whole.

Synthetic film materials suitable for repeated shrinking by the application of heat may be selected, for example, from polyethylene terephtalates (PETP).

Although the invention has been described with reference to specific example embodiments, it will be appreciated, that it is intended to cover all modifications and equivalents within the scope of the appended claims.

What we claim is:

1. A method of treating filamentary textile material which is wound on lap creels capable of being assembled to form stacks, comprising the following steps:

(a) enveloping a stack with a repeatedly shrinkable film material, (b) first shrinking of said film material onto said stack to form a film envelope on each stack, (c) assembling prior to treatment, several stacks to form a column in which each stack is individually enclosed by its film envelope, (d) applying longitudinally, axially effective pressure to said column to form a compressed column, whereby tension of said film envelopes is slackened again and the film forms wrinkles, (e) and exposing the compressed column to a heated textile treatment medium acting upon the textile material, said heated treatment medium simultaneously causing a second shrinking of said film envelopes until the film material again tautly surrounds each stack in the axially compressed column.

2. The method of claim 1, wherein said second shrinking is brought about at the beginning of a treatment of said textile material by said heated treatment medium.

3. The method of claim 1, wherein the number of wound lap creels for each stack is selected with regard to ease of handling, transportability, and the ability of the film to protect the stack against damage.

4. The method of claim 1, wherein each stack is assembled to include three to six wound lap creels, and wherein each column is formed to include two or three stacks.

5. The method of claim 1, wherein perforated shrinkable film material is used, and causing said heated treatment medium to flow through perforations in said film material for an improved second shrinking without interfering with the treatment of said textile material by said heated treatment medium.

6. The method of claim 1, wherein said first shrinking step is performed immediately upon completion of the winding of the lap creels.

* * * * *